US007568698B2

(12) United States Patent
Bertrand

(10) Patent No.: US 7,568,698 B2
(45) Date of Patent: Aug. 4, 2009

(54) TRAY FOR HOLDING GAME PIECES

(75) Inventor: Lesker L. Bertrand, Round Rock, TX (US)

(73) Assignee: Kim Estes, Cypress, CA (US)

( * ) Notice: Subject to any disclaimer, the term of this patent is extended or adjusted under 35 U.S.C. 154(b) by 1468 days.

(21) Appl. No.: 09/956,195

(22) Filed: Sep. 19, 2001

(65) Prior Publication Data

US 2003/0052448 A1 Mar. 20, 2003

(51) Int. Cl.
*A63F 1/10* (2006.01)

(52) U.S. Cl. ..... 273/150; 273/148 R; 273/148 A

(58) Field of Classification Search ..... 273/309, 273/148 R, 148 A, 150; 40/124, 124.1; D21/392; 217/65, 12 R; 229/115
See application file for complete search history.

(56) References Cited

U.S. PATENT DOCUMENTS

| | | | | | |
|---|---|---|---|---|---|
| 1,508,082 | A | * | 9/1924 | Boeppler | 273/150 |
| 1,557,774 | A | * | 10/1925 | Pool et al. | 273/150 |
| 1,569,701 | A | * | 1/1926 | Bostrom | 273/150 |
| 1,588,618 | A | * | 6/1926 | Rosen | 273/150 |
| 1,749,653 | A | | 3/1930 | Winter | |
| 1,919,922 | A | * | 7/1933 | Baker et al. | 273/148 A |
| 2,211,480 | A | * | 8/1940 | Ring | 248/445 |
| D188,859 | S | | 9/1960 | Clement | |
| D248,332 | S | | 6/1978 | Bailey et al. | |
| 4,146,229 | A | * | 3/1979 | Morse | 273/150 |
| D262,727 | S | | 1/1982 | Snyder | |
| 4,538,813 | A | * | 9/1985 | Pergeau | 273/150 |
| 4,646,927 | A | * | 3/1987 | Williams et al. | 217/12 R |
| 6,168,156 | B1 | | 1/2001 | Gonzalez | |

FOREIGN PATENT DOCUMENTS

| | | | | |
|---|---|---|---|---|
| EP | 363296 | * | 4/1990 | 273/148 A |
| GB | 2185415 | * | 7/1987 | 273/150 |

* cited by examiner

*Primary Examiner*—Raleigh W. Chiu
(74) *Attorney, Agent, or Firm*—Dillon & Yudell LLP; Brian F. Russell

(57) ABSTRACT

A tray for holding game pieces which have indicia on only one side thereof, such as domino tiles, Scrabble® tiles or playing cards. An elongate generally rectangular base having a reflective surface is mounted in association with an elongate transparent easel portion, at an acute angle along one edge thereof, so that the transparent easel portion overlies the reflective base. The indicia on a lower surface of each game piece which is mounted on the elongate transparent easel portion can then be viewed in reflection within the generally rectangular base from only one side so that the identity of each game piece may be readily determined without requiring a player to lift and manipulate the game piece.

8 Claims, 2 Drawing Sheets

TRAY FOR HOLDING GAME PIECES

BACKGROUND OF THE INVENTION

1. Technical Field

The present invention relates in general to a tray for holding game pieces which have indicia on only one side thereof, such as domino tiles, Scrabble® tiles or playing cards. (Scrabble® is a registered trademark of Hasbro, Inc.). And in particular, the present invention relates to a tray for holding game pieces so that the indicia may be viewed. Still more particularly the present invention relates to a tray for holding game pieces so that only one player can view the game piece indicia without requiring the game pieces to be lifted or manipulated.

2. Description of the Related Art

Card games, board games and tile games have been known for many centuries. In such games each player possesses and uses a group of cards, game pieces or tiles which typically include numeric or other indicia on only one side thereof and wherein each player typically attempts to view such indicia without revealing those indicia to his or her opponents.

Various games, such as domino games double six, nine, twelve, 42, Chicken Foot or MahJong, require a player to utilize and manipulate a large number of tile pieces. As players become older and less physically coordinated the necessity of repeatedly lifting and manipulating the game pieces to examine the numeric indicia becomes more and more burdensome. Additionally, less accurate short term memory skills make such examinations more frequent among older players.

Examples of racks or trays for holding playing cards or game pieces may be seen in U.S. Design Pat. No. 188,859, U.S. Design Pat. No. 248,332 and U.S. Design Pat. No. 262,727. Additionally, utility patents such as U.S. Pat. Nos. 1,749,653 and 6,168,156 disclose various stands or trays which may be utilized to hold game pieces or cards.

Upon a review of these existing game piece trays it should be apparent that a device which supports game pieces or tiles in a way which permits only the players sitting near those game pieces or tiles to see the indicia on those game pieces or tiles, without requiring physical manipulation of the game pieces or tiles would be a great advance in such leisure activities.

SUMMARY OF THE INVENTION

It is therefore one object to the present invention to provide a tray for holding game pieces which include indicia on only one side of each game piece.

It is another object to the present invention to provide a tray for holding game pieces which include indicia on only one side of each game piece which permits those indicia to be viewed.

It is yet another object to the present invention to provide a tray for holding game pieces which include indicia on only one side of each game piece which permits those indicia to be viewed without requiring lifting or manipulating of the game pieces.

The foregoing objects are achieved as is now described. A tray is provided for holding game pieces which have indicia on only one side thereof, such as domino tiles, Scrabble® tiles or playing cards. An elongate generally rectangular base having a reflective surface is mounted in association with an elongate transparent easel portion, at an acute angle along one edge thereof, so that the transparent easel portion overlies the reflective base. The indicia on a lower surface of each game piece which is mounted on the elongate transparent easel portion can then be viewed in reflection within the generally rectangular base from only one side so that the identity of each game piece may be readily determined without requiring a player to lift and manipulate the game piece.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
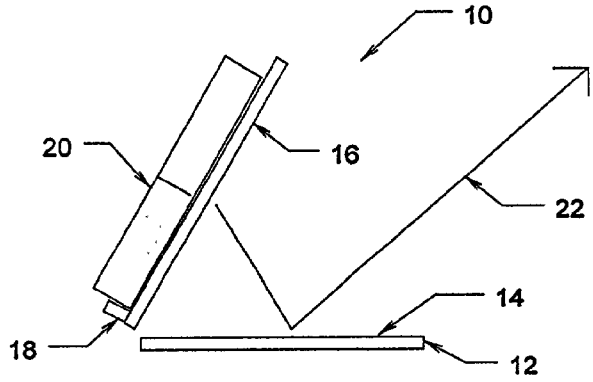
FIG. 1 is a schematic side view of the game piece tray of the present invention.

With reference now to the Figures and in particular with reference to FIG. 1 there is depicted a schematic side view of a game piece tray 10 of the present invention. As illustrated, game piece tray 10 includes an elongate generally rectangular base portion 12 which includes a reflective surface 14. An elongate transparent easel portion 16 is depicted as mounted at an acute angle overlying elongate generally rectangular base portion 12. A retaining ledge 18 is mounted perpendicular to the lower surface of elongate transparent easel portion 16 so that a domino 20 or other game piece may be mounted on elongate transparent easel portion 16 with the numeric indicia on the lower surface thereof.

Thus, upon reference to the schematic representation of FIG. 1, those having ordinary skill in the art will appreciate that the numeric indicia on the lower surface of domino 20 can be visually ascertained in the reflection from reflective surface 14 along the sight line generally indicated at reference numeral 22. Thus, a player utilizing game piece tray 10 can mount a plurality of dominos or other game pieces on elongate transparent easel portion 16 and view the numeric indicia associated with each game piece without lifting or manipulating dominoes 20.

Figure 2:
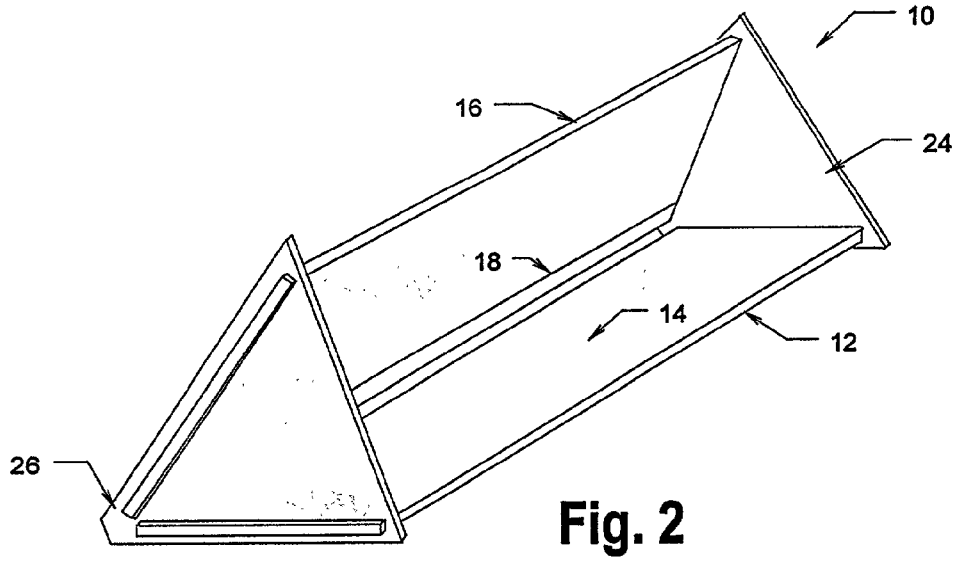
FIG. 2 is a prospective view of one embodiment of the game piece tray of the present invention.

Referring now to FIG. 2 there is depicted a prospective view of one embodiment of the game piece tray 10 of the present invention. As depicted herein, elongate generally rectangular base portion 12 and elongate transparent easel portion 16 are held in the desired acute angle relationship by means of end panels 24 and 26. As will be described in greater detail herein, each end panel includes a plurality of slots which can be utilized to receive an end portion of elongate generally rectangular base portion 12 and elongate transparent easel portion 16 so that elongate transparent easel portion 16 can be maintained at an acute angle overlying elongate generally rectangular base portion 12. In the depicted embodiment of the present invention the angle between elongate generally rectangular base portion 12 and elongate transparent easel portion 16 is approximately 60°.

Figure 3:
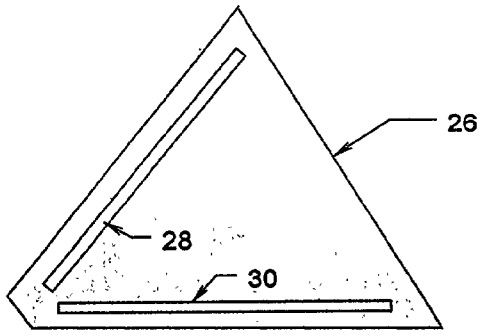
FIG. 3 is a plan view of one end panel of the game piece tray of FIG. 2.

With reference now to FIG. 3 there are depicted slots 28 and 30 within one end panel 26 which can receive an end portion of elongate generally rectangular base portion 12 and elongate transparent easel portion 16 in the embodiment depicted within FIG. 2. In this manner, as those having ordinary skill in the art will appreciate upon reference to the present disclosure, game piece tray 10 can be disassembled and packaged in a flat container. Alternatively, without departing from the spirit and intent of the present invention, elongate transparent easel portion 16 may be permanently mounted in the depicted acute angle relationship with elongate generally rectangular base portion 12 or alternatively, a live hinge or other flexible means may be utilized to establish and maintain the relationship between the two portions.

Figure 4:
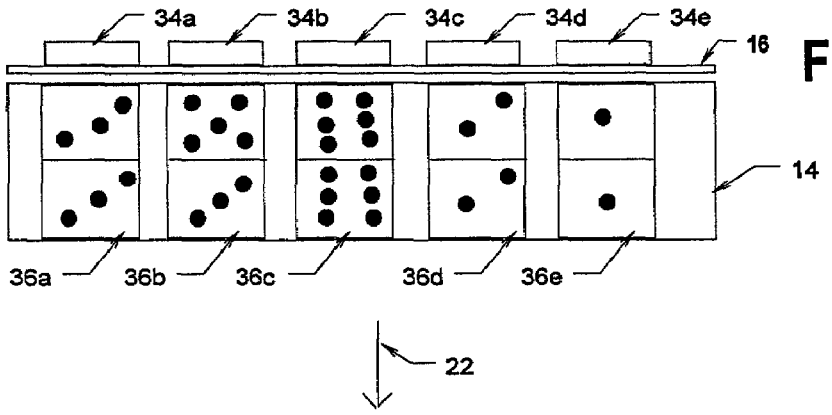
FIG. 4 is a pictorial illustration of the sight line of a plurality of dominos mounted in the game piece tray of the present invention.

Referring now to FIG. 4 there is depicted a pictorial illustration of the sight line 22 of a plurality of dominos 34*a*-34*e* which are mounted on elongate transparent easel portion 16. As illustrated, the indicia on the lower surface of each domino is reflective within the reflective surface 14 of elongate generally rectangular base portion 12 at reference numerals 36*a*-36*e*. In this manner, those having ordinary skill in the art will appreciate that the indicia associated with a large number of dominos can be viewed only by the player seated along sight line 22 and the indicia may be observed without requiring physical manipulation or lifting of the domino tiles.

Figure 5:
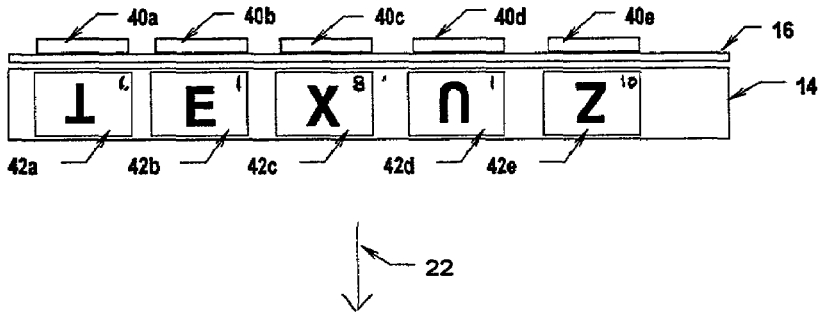
FIG. 5 is a pictorial illustration of the sight line of a plurality of Scrabble® tiles mounted in the game piece tray of the present invention.

With reference now to FIG. 5 there is depicted a pictorial illustration of sight line 22 in an alternate embodiment of the present invention wherein a plurality of Scrabble® tiles 40*a*-40*e* are mounted on elongate transparent easel portion 16. As depicted, the indicia associated with each tile is visible within reflective surface 14 of the elongate generally rectangular base portion as illustrated at reference numerals 42*a*-42*e*. However, as noted, mirror imaging results in a less than optimal visual indication; however, those individuals familiar with this game will be able to discern the indicia of each tile in this manner.

Figure 6:
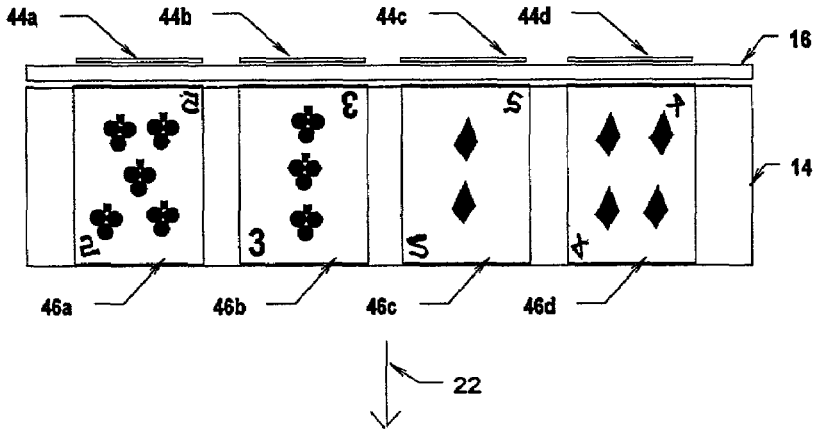
FIG. 6 is a pictorial illustration of the sight line of a plurality of playing cards mounted in the game piece tray of the present invention.

Finally, referring to FIG. 6 there is depicted a pictorial illustration of sight line 22 of a plurality of playing cards 44*a*-44*d* which are mounted on elongate transparent easel portion 16. As depicted, the indicia associated with each playing card is reflected within reflective surface 14 of the elongate generally rectangular base portion as indicated at reference numerals 46*a*-46*d*.

Of course, the actual width of game piece tray 10 maybe varied to accommodate a greater or lesser number of tiles, cards or the like, as a simple matter of design choice.

Upon reference to the foregoing those skilled in the art will appreciate that the present Application discloses a game tray for holding game pieces which have indicia on only one side thereof such that the indicia may be observed by a player seated at a specific location relative to the game tray without requiring the user to physically lift or manipulate the game pieces, greatly enhancing the enjoyability of such games for those individuals having limited physical capability.

The embodiments and examples set forth herein are presented in order to best explain the present invention and its practical application and, thereby, to enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit and scope of the following claims.

What is claimed is:

1. A tray for holding game pieces having indicia on only one side thereof such that said indicia is visible from a single general direction, said tray comprising:

an elongate generally rectangular base portion having a reflective surface;

an elongate transparent easel portion sized to support a plurality of game pieces;

a pair of generally triangular shaped end panels, each generally triangular shape end panel having an elongate slot along and parallel to each of two sides of said generally triangular shaped end panels;

one of said elongate slots sized to receive an end of said elongate generally rectangular base portion; and a second of said elongate slots sized to receive an end of said elongate transparent easel portion wherein said tray may be disassembled and packaged in a flat container and wherein said assembled tray is constructed of not more than four generally planar panels.

2. The tray for holding game pieces according to claim 1 wherein said elongate transparent easel portion is mounted at approximately a 60° angle along one edge of said elongate generally rectangular base portion.

3. A tray for holding game pieces having indicia on only one side thereof according to claim 1 further including a retaining ledge mounted along one edge of said elongate transparent easel portion.

4. A fray for holding game pieces having indicia on only one side thereof according to claim 3 wherein said retaining ledge is mounted perpendicular to said elongate transparent easel portion along one edge thereof.

5. A tray for holding game pieces having indicia on only one side thereof according to claim 1 wherein said elongate transparent easel portion is constructed of plastic.

6. A tray for holding game pieces having indicia on only one side thereof according to claim 5 wherein said elongate transparent easel portion is constructed of acrylic plastic.

7. A tray for holding game pieces having indicia on only one side thereof according to claim 1 wherein said elongate transparent easel portion is sized to support domino game tiles.

8. A fray for holding game pieces having indicia on only one side thereof according to claim 1 wherein said elongate transparent easel portion is sized to support playing cards.

* * * * *